US012576342B1

(12) United States Patent
McNeny

(10) Patent No.: US 12,576,342 B1
(45) Date of Patent: Mar. 17, 2026

(54) TABLETOP TOTEM

(71) Applicant: Larry McNeny, Celina, TX (US)

(72) Inventor: Larry McNeny, Celina, TX (US)

( * ) Notice: Subject to any disclaimer, the term of this patent is extended or adjusted under 35 U.S.C. 154(b) by 0 days.

(21) Appl. No.: 19/321,379

(22) Filed: Sep. 8, 2025

(51) Int. Cl.
*A63H 3/16* (2006.01)
*A63H 3/50* (2006.01)

(52) U.S. Cl.
CPC ..... *A63H 3/16* (2013.01); *A63H 3/50* (2013.01)

(58) Field of Classification Search
CPC ... A63H 3/00; A63H 3/16; A63H 3/50; A63H 33/067
USPC ..... 446/97
See application file for complete search history.

(56) References Cited

U.S. PATENT DOCUMENTS 2,767,517 A * 10/1956 Hooper ..... A63H 33/26 446/139
3,159,403 A * 12/1964 Glass ..... A63F 9/0098 273/272
3,392,480 A * 7/1968 Stubbmann ..... A63H 33/08 446/101
3,581,432 A * 6/1971 Bass ..... A63H 3/50 446/285
3,663,717 A * 5/1972 Coster ..... A63H 33/067 428/542.2
3,748,778 A * 7/1973 Ellies ..... A63H 33/067 446/106
4,226,045 A * 10/1980 Lehmann ..... A63H 3/48 446/101
D300,542 S * 4/1989 Thomson ..... D21/471
4,897,066 A * 1/1990 Tapdrup ..... A63F 9/00 446/124
4,954,114 A * 9/1990 Kawashima ..... A63H 3/00 446/268
5,718,549 A * 2/1998 Noda ..... F16B 5/0657 411/553
6,966,813 B2 * 11/2005 Donahue ..... A63H 33/067 446/124
7,766,716 B2 * 8/2010 Fong ..... A63H 3/16 446/99
8,007,338 B2 * 8/2011 Stevkovski ..... A63H 33/062 446/124
8,062,088 B2 * 11/2011 Perry ..... A63H 33/046 446/139
9,086,087 B1 * 7/2015 Sharman ..... F16B 21/04
9,546,675 B2 * 1/2017 Evitt ..... A47B 47/005
9,919,231 B1 * 3/2018 Chin ..... A63H 33/046
D916,986 S * 4/2021 Ribbens ..... D21/493
11,302,218 B2 * 4/2022 Kim ..... G09B 19/00
D999,285 S * 9/2023 Buelens ..... D21/399
(Continued)

*Primary Examiner* — Kurt Fernstrom
(74) *Attorney, Agent, or Firm* — Michael Diaz

(57) ABSTRACT

A totem display. The totem display includes a base figurine having a flat base platform and a second figurine. Additionally, the totem display includes a latching mechanism for detaching and attaching the second figurine to a top portion of the base figurine. The base figurine and second figurine are aligned vertically when the second figurine is attached to the base figurine. The totem display may also attach additional figurines in a vertical alignment on top of the second figurine. The figurines may be any character, such as sporting figurines, political or religious leaders, actors/actresses, film characters, musical celebrities, composers, cartoon or action figurines.

15 Claims, 9 Drawing Sheets

(56) References Cited

U.S. PATENT DOCUMENTS

| | | | | |
|---|---|---|---|---|
| 2003/0190855 | A1* | 10/2003 | Teel | A63H 33/06 446/101 |
| 2007/0072516 | A1* | 3/2007 | Liff | A63H 3/50 446/478 |
| 2018/0056208 | A1* | 3/2018 | Nakashima | A63H 3/16 |
| 2018/0250604 | A1* | 9/2018 | Keesee, Jr. | A63H 33/003 |
| 2025/0161832 | A1* | 5/2025 | Adams | A63H 3/50 |

* cited by examiner

TABLETOP TOTEM

BACKGROUND OF THE INVENTION

Field of the Invention

This invention relates to display devices. Specifically, and not by way of limitation, the present invention relates to a device having a plurality of customizable figures or characters aligned vertically as a totem.

Description of the Related Art

There are various display devices utilized in offices and homes which display a wide range of items. Normally these displays show flat graphics or actual three-dimensional items, such as figurines, statutes, etc. However, none of these displays allow the formation of a line of figurines or three-dimensional items vertically aligned such as in a totem. Additionally, there are no displays which provide a detachable connection between a plurality of these three-dimensional items. It would be advantageous to have a display which enables the semi-permanent attachment of a plurality of three-dimensional items, such as figurines or statutes in a secure vertical totem fashion. It also would be advantageous to have a display which allows the customization of the three-dimensional items as desired by the owner. It is the object of the present invention to provide such a display.

SUMMARY OF THE INVENTION

In one aspect, the present invention is directed to a totem display. The totem display includes a base figurine having a flat base platform and a second figurine. Additionally, the totem display includes a latching mechanism for detaching and attaching the second figurine to a top portion of the base figurine. The base figurine and second figurine are aligned vertically when the second figurine is attached to the base figurine. The totem display may also attach additional figurines in a vertical alignment on top of the second figurine. The figurines may be any character, such as sporting figurines, political or religious leaders, actors/actresses, film characters, musical celebrities, composers, cartoon or action figurines.

DESCRIPTION OF THE INVENTION

Figure 1:
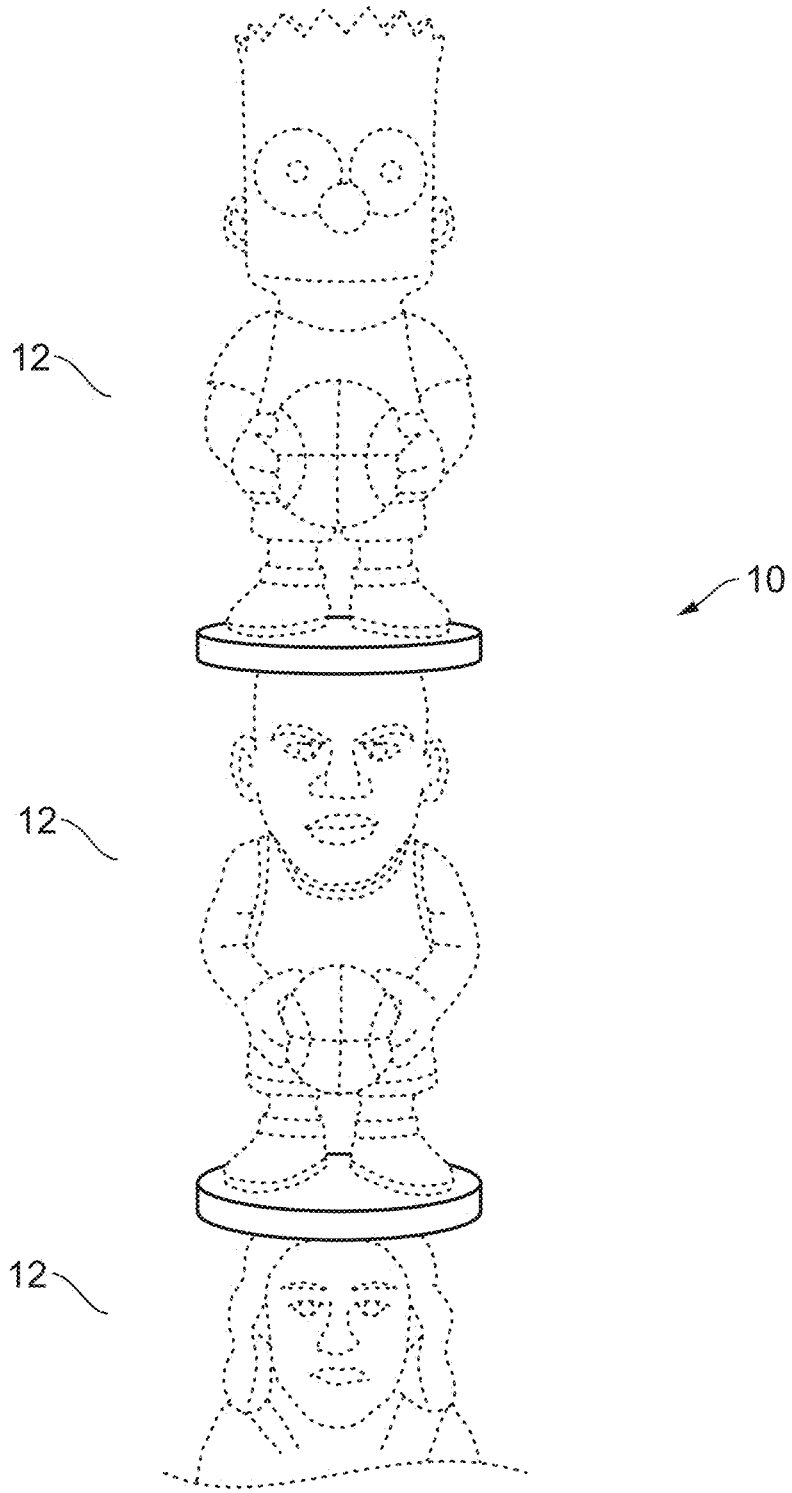
FIG. 1 is a front view of a totem display having a plurality of figurines in one embodiment of the present invention

The present invention is a display providing the semi-permanent attachment of a plurality of three-dimensional items, such as figurines or statutes, in a secure vertical totem fashion. FIG. 1 is a front view of a totem display 10 having a plurality of figurines 12 in one embodiment of the present invention. In the preferred embodiment of the present invention, a plurality of the figurines may be any three-dimensional item of any size which are stacked and latched in a semi-permanent position utilizing a novel attachment mechanism to form a totem pole system display. Preferably, the figurines are created through the use of plastic mold injections. The figurines may be any character, such as sporting figurines, political or religious leaders, actors/actresses, film characters, musical celebrities, composers, cartoon or action figurines and in some embodiments may be customized to appear like one's own family, such as a father, mother or any other inspirational character. In one embodiment, the figurines are approximately 3.5 inches in height and two inches in width.

Figure 2:
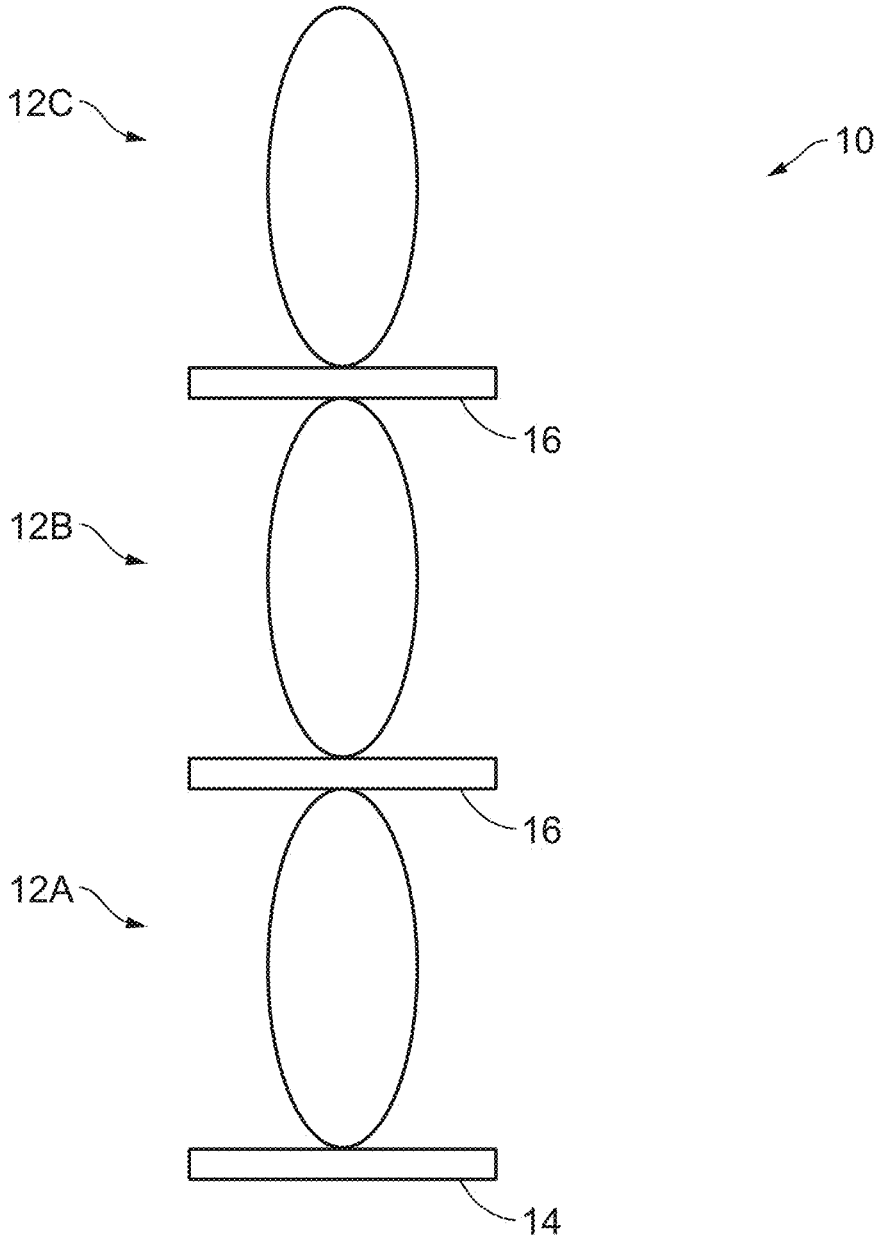
FIG. 2 is a block diagram illustrating the totem display with the base figurine and stacked figurines.

FIG. 2 is a block diagram illustrating the totem display 10 with a base figurine 12A and stacked figurines 12B and 12C. Base figurine 12A includes a base platform 14 providing a stable base for the totem display 10 configured for placement on any flat surface. In one embodiment, the base platform is a flat piece of rigid material sufficiently sized to provide stability of the totem display 10 with a plurality of stacked figurines 12. The shape of the base platform 14 may be any shape, such as circular, rectangular or square. Preferably the base platform is a solid heavy material, such as plastic having a receiving area on the top surface of the base platform for holding and retaining the base FIG. 12A. Between the base figurine 12 and figurine 12B is a conjoined platform 16. Additionally, between the top of the figurine 12B and the bottom of figurine 12C is a conjoined platform. Between each stacked figurine is a conjoined platform 16. Although three figurines are depicted in FIG. 2, any number of figurines may be stacked in the totem display 10 and still remain in the scope of the present invention. Each conjoined platform provides a unique attachment mechanism for stacking and securing the figurines in a semi-permanent manner.

Figure 3:
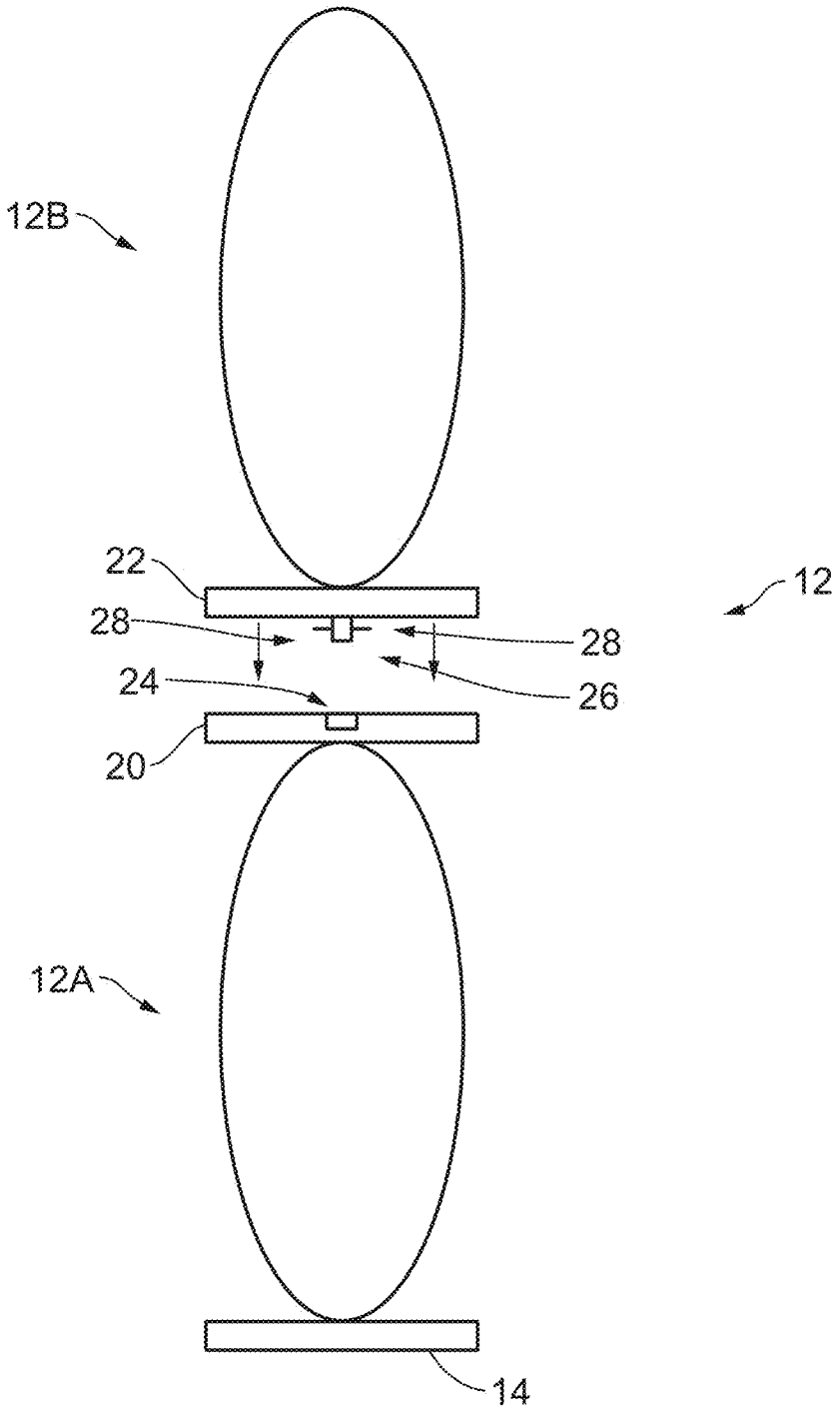
FIG. 3 is an enlarged front view of the totem display of FIG. 2 in one embodiment of the present invention.
Figure 4:
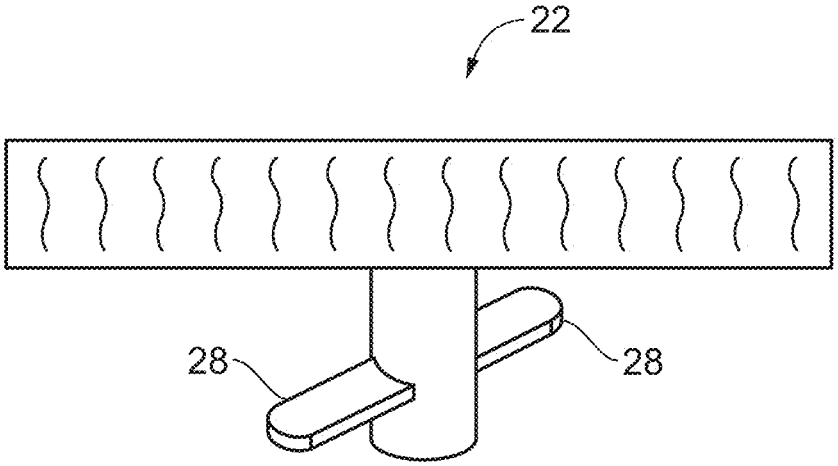
FIG. 4 is a front perspective of the male platform with the extension and the latching arms.

FIG. 3 is an enlarged front view of the totem display 10 of FIG. 2 in one embodiment of the present invention. The conjoined platform 16 is comprised of two parts, a receiving platform 20 located on a top of the figurine 12 (in this illustration on top of figurines 12A) and a male platform 22 located on a bottom of a stacked figurine 12 (in this illustration on the bottom of figurine 12B). The receiving platform 20 is affixed to the top of the figurine 12A and includes a recess area 24. The male platform 22 includes an extension 26 having latching arms 28. Both the receiving platform 20 and male platform 22 may be any size and dimension with any width and shape. The recess area is sized and shaped to accommodate the extension 26 when inserted and locked in place. When latched together, the receiving platform 20 and male platform 22 form the conjoined platform 16. In one embodiment, the conjoined platform is circular in shape and has the appearance of wood. FIG. 4 is a front perspective of the male platform 22 with the extension 26 and the latching arms 28. Although the dimensions of the extension 26 and 28 may be any size, the latching arms 28 are preferably configured to cover 86 degrees of a 360 circumference. Preferably the extension and latching arms are solid.

Figure 5:
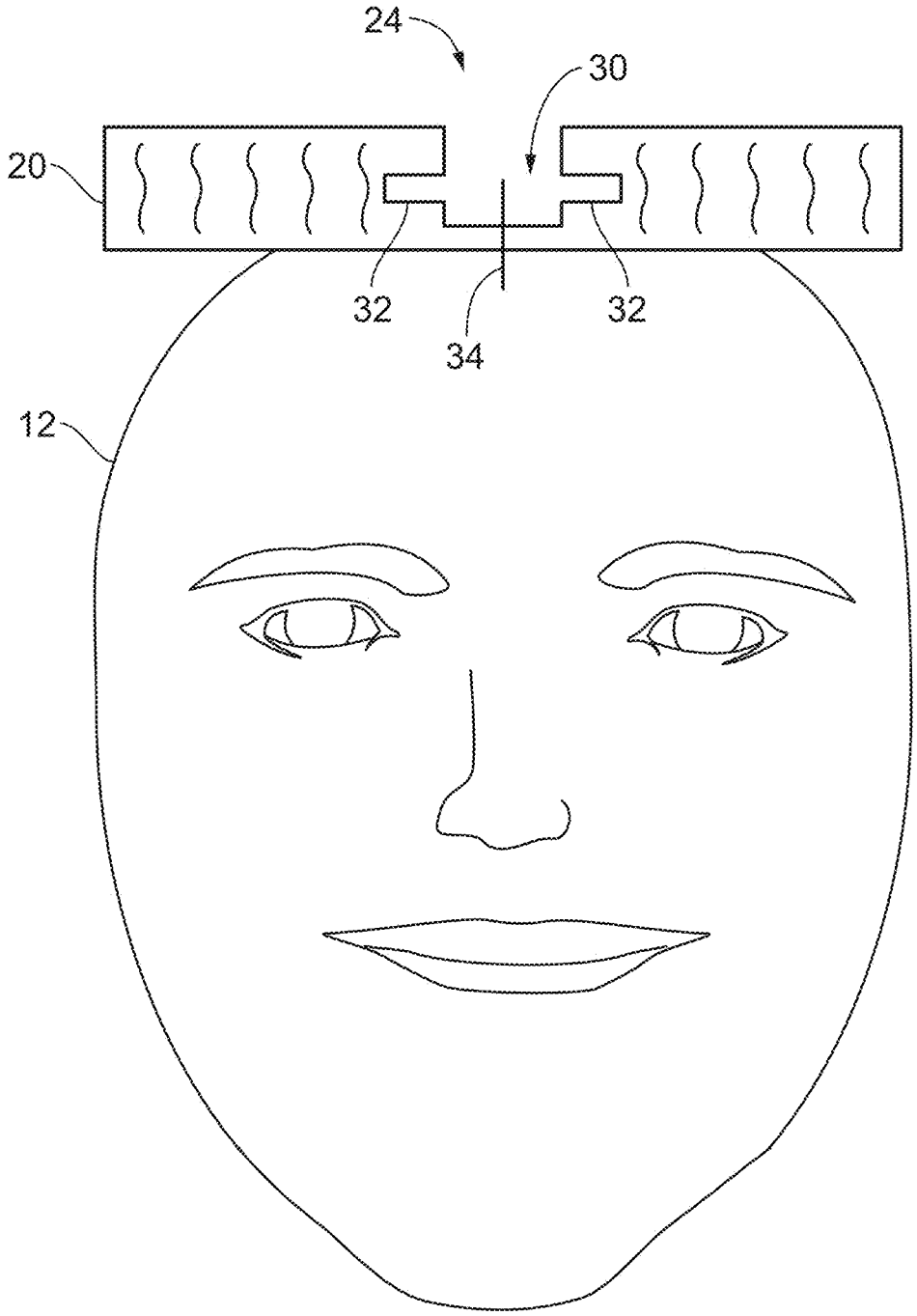
FIG. 5 is an enlarged front view of the figurine with the receiving platform.

FIG. 5 is an enlarged front view of the figurine 12 with the receiving platform 20. Within the recess area 24 is an extension recessed area 30 sized and shaped to accommodate the extension 26 of the stacked male platform 22 (not shown in FIG. 5). Additionally, the recess area 24 includes a latching arm recessed area 32 to accommodate the latching arms 26. latching arm recessed area 32 extends the open area through the entire circumference of the recess area 24, expanding out from a center point 34 of the recess area.

Figure 6:
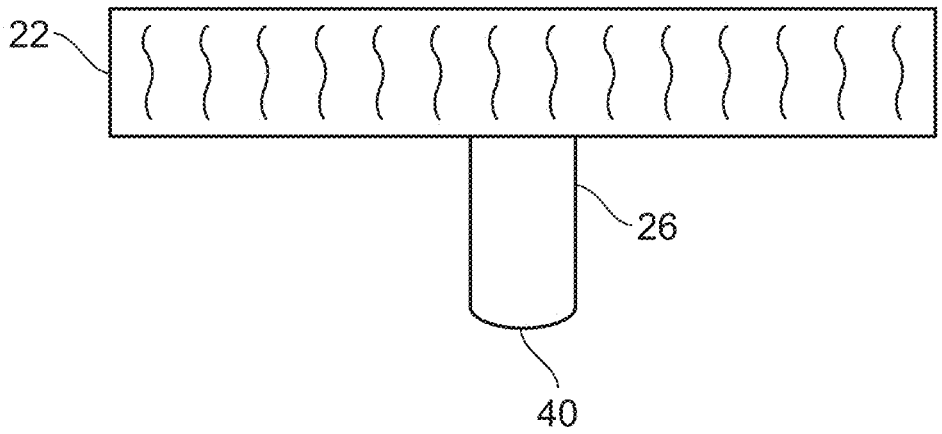
FIG. 6 is a side view of the male platform.
Figure 7:
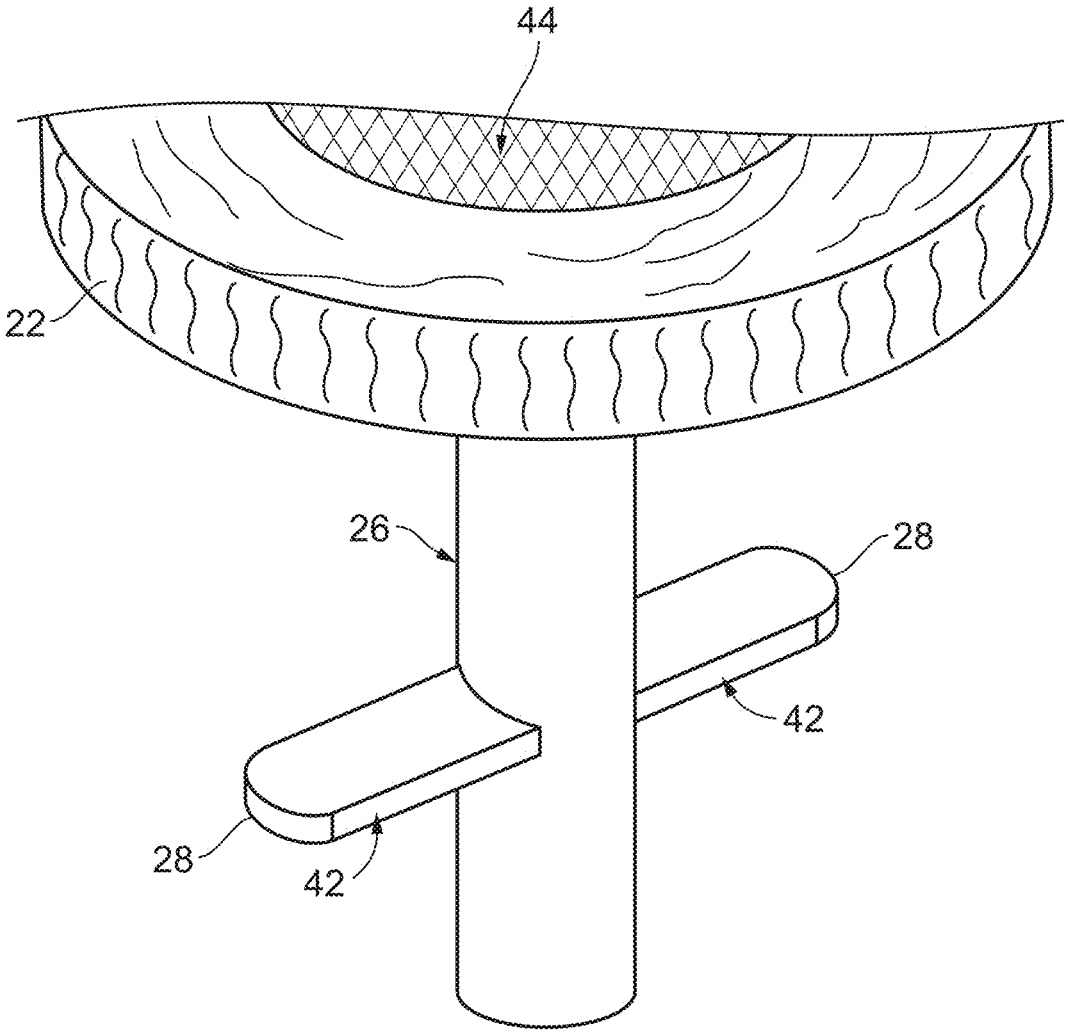
FIG. 7 is a front perspective partial view of the male platform.

FIG. 6 is a side view of the male platform 22. In one embodiment of the present invention, the male platform is approximately two inches in diameter and circularly shaped with the width of the extension of ¼ of an inch and a length of 15⁄32 inches. The extension 26 includes a rounded ended 40 to facilitate ease in placement of the extension 26 into the recess area 24 when latching two figurines 12 together. The latching arms 28 are not shown in FIG. 6. FIG. 7 is a front perspective partial view of the male platform 22. As depicted in FIG. 7, the extension 26 extends down from the male platform 22. The extension 26 includes two latching arms 28 extending out approximately perpendicular to the extension 26. Preferably, each latching arm includes a width covering approximately 86 degrees of the circumference around the extension. However, the latching arms may be any width and may be any number, i.e., more than two. In one embodiment, the latching arms 28 include beveled edges 42 for attaching and detaching the male platform 22 from the receiving platform 20. The male platform 22 may include a figurine receiving area 44 for attaching a figurine to a top of the male platform 22.

Figure 8:
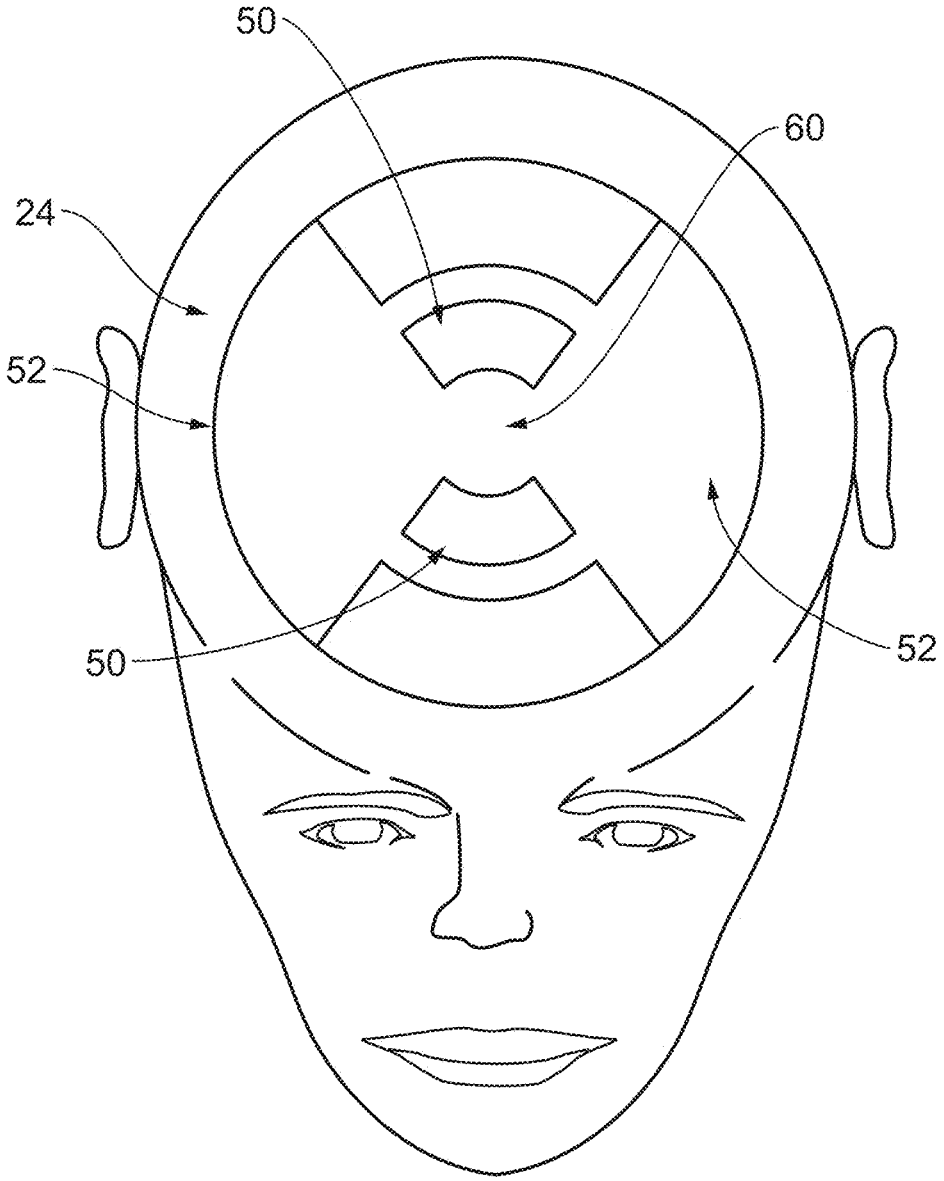
FIG. 8 is a top view of the recess area.

FIG. 8 is a top view of the recess area 24. In one embodiment, to accommodate and hold the latching arms 28 in place, the recess area includes covered areas 50 and open areas 52. The covered areas 50 are each substantially the same width as each latching arm 28. The open areas are the remaining open area of the recess area 24. In one embodiment, each covered area 50 covers 86 degrees of the circumference of the recess area and each open area covers 94 degrees of the recess area. The dimensions may differ for the covered area and open area but still remain in the scope of the present invention. The covered area 50 show approximate match the angular width of the latching arms. In one embodiment, the latching arms have a width of 86 degrees relative to the circumference around the extension. With this dimension, the covered area 50 is approximately 86 degrees to sufficiently cover one latching arm. The covered areas 50 retain the latching arm in place. The cover area includes a center opening 60 to accommodate the extension 26. When inserting the extension 26 into the recess area 24, the latching arms are aligned to be within the open areas 52. Once the extension 26 is seated completely through the center opening 60, the male platform 22 is twisted to move the arms under the covered areas 50, thereby latching the male platform 22 in place to the receiving platform 20. The latching areas are free to moving in the latching arm recessed area 32, which is sized to accommodate movement of the latching arms in the recess area. In one embodiment, the male platform is twisted 45 degrees and when the male platform 22 is latched, the figurine is facing to a front of the totem display 10.

Figure 9:
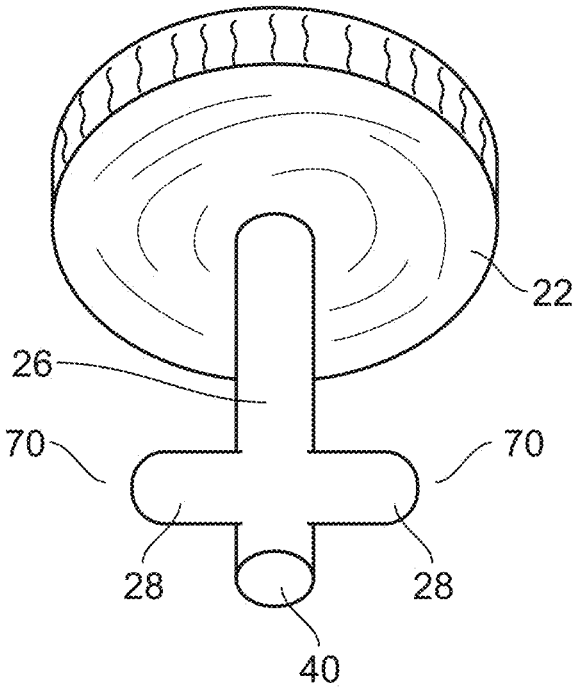
FIG. 9 is a front perspective view of the male platform with the extension.
Figure 10:
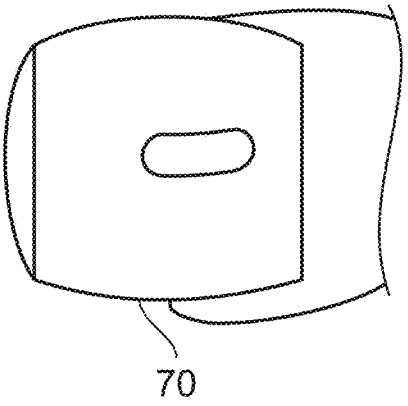
FIG. 10 illustrates the wedge tip removed from the latching arm of FIG. 9.

FIG. 9 is a front perspective view of the male platform 22 with the extension 26. The latching arms 28 may include wedge tips 70 located on the ends of the latching arms. FIG. 10 illustrates one of the wedge tips 70 removed from the latching arm of FIG. 9. The wedge tips are sized and shaped to facilitate insertion of the extension and latching arms into the recess area.

With reference to FIGS. 1-10, the operation of the totem display 10 will now be explained. First, the user selects the figurines 12 and order in the stack for the figurines. The figurines may be any character such as sporting figures, political or religious leaders, actors/actresses, film characters, musical celebrities, composers, cartoon or action figurines and in some embodiments may be customized to appear like one's own family, such as father, mother or any other inspirational character. In one embodiment, the figurines are approximately 3.5 inches in height and two inches in width. A base figurine 12A is selected from the selected figurines 12. Next, the base platform 14 is secured to the bottom of the figurine 12A (base figurine). One of the receiving platforms 20 is then secured to the top of the figuring 12A. The next figurine 12B (see FIG. 2) is affixed with the male platform 22. The figurine 12B is latched in place to the top of the figurine 12A. Specifically, the extension 26 is inserted into the recess area 24 with the latching arms aligned with the open areas 52. Once the extension 26 is seated completely through the center opening 60, the male platform 22 is twisted to move the latching arms under the covered areas 50, thereby latching the male platform 22 in place to the receiving platform 20. The latching areas are free to move in the latching arm recessed area 32, which is sized to accommodate movement of the latching arms in the recess area. In one embodiment, the male platform is twisted 45 degrees and when the male platform 22 is latched, the figurine is facing to a front of the totem display 10 and locked in place. In a similar manner, other figurines such as figurines 12C are stacked on top of underline figurine 12. For each added figurine, a receiving platform 20 is affixed to the top of the underlying figurine and the male platform 22 is affixed to the bottom of the stacked figurine 12. The user may select any number and type of figurines to customize the totem display 10. The totem display may include a wood appearing surface to provide a resemblance to an actual totem pole. Additionally, figurines may be added, removed or replaced as desired by the user as the latching mechanism holding the figurines in place allows the detachment and reattachment of figurines. In one embodiment, the latching arms define a circumferential span and are insertable exclusively through the open entry regions of the receiving platform in an axial direction, and engagement is completed by rotational displacement of the second figurine which translates each latching arm from the open entry region into a covered retention region positioned above the latching arm. The covered retention regions physically block axial withdrawal of the latching arms absent reverse rotation, thereby forming a torsion-locked conjoined platform providing a semi-permanent attachment of the second figurine to the base figurine.

In other embodiments of the present invention, any latching mechanism may be utilized which semi-permanently secures the figurines in a stacked configuration. For example, although the male platform 22 is located as the upper platform in the conjoined platform 16, the male platform 22 may be the lower piece with the receiving platform 20 located on top, the reverse of the latching mechanism discussed in FIGS. 1-10.

With the present invention, the user may select desired figurines the user finds appealing and motivating in the user's life. With this customization, each totem display may be different and unique. While the totem displays are unique in design, they do entertain and evoke a broad variety of emotions and feelings in the user created the display totem. The totem display provides a unique, customizable display of a plurality of figurines in a stacked orientation which may be attached and reattached as desired through a novel latching mechanism for each stacked figurine. With the capability to select different figurines, the totem display is personal for each user.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A totem display, the display comprising:

a base figurine having a flat base platform;

a second figurine;

a latching mechanism for detaching and attaching the second figurine to a top portion of the base figurine;

wherein the latching mechanism comprises a male platform including an extension having a plurality of latching arms, and a receiving platform including a recess area having open and covered portions configured to receive the extension and to retain the latching arms beneath the covered portions upon twisting engagement to form a conjoined platform;

wherein the male platform and the receiving platform have substantially the same outer peripheral shape and dimensions and are affixed to facing surfaces of the base figurine and the second figurine such that the conjoined platform appears as a single continuous platform;

wherein the base figurine and second figurine are aligned vertically when the second figurine is attached to the base figurine via the latching mechanism and wherein the conjoined platform provides a semi-permanent attachment of the second figurine to the base figurine.

2. The totem display according to claim 1 wherein the male platform is attached to the base figurine or the second figurine and the receiving platform is attached to the base figurine or the second figurine.

3. The totem display according to claim 2 wherein the male platform includes an extension and the receiving platform includes a recess area for receiving and retaining the extension.

4. The totem display according to claim 2 wherein the male platform is affixed to a bottom portion of the second figurine and the receiving platform is affixed to a top portion of the base figurine.

5. The totem display according to claim 2 wherein the male platform is affixed to a top portion of the base figurine, and the receiving platform is affixed to a bottom portion of the second figurine.

6. The totem display according to claim 1 further comprising a third figurine and a second latching mechanism, the second latching mechanism for detaching and attaching the third figurine to a top portion of the second figurine.

7. The totem display according to claim 6 wherein the base figurine, second figurine, and third figurine are aligned vertically when the second figurine is attached to the base figurine, and the third figurine is attached to the second figurine.

8. The totem display according to claim 7 wherein the second latching mechanism comprises a second male platform and a second receiving platform, the second male platform being attached to the third figurine or the second figurine and the second receiving platform being attached to the third figurine or the second figurine.

9. The totem display according to claim 8 wherein the second male platform includes a second extension and the second receiving platform includes a second recess area for receiving and retaining the second extension.

10. The totem display according to claim 1 further comprising a plurality of figurines, each figurine attached to an underlying figurine by a latching mechanism, each figurine being aligned vertically.

11. The totem display according to claim 1 wherein the base figurine and the second figurine have a wood surface appearance.

12. The totem display of claim 1, wherein each of the base figurine and the second figurine is a customizable three-dimensional character selected from the group consisting of sporting figurines, political or religious leaders, actors or actresses, film characters, musical celebrities, composers, cartoon figurines, and action figurines.

13. A totem display, the display comprising:

a base figurine having a flat base platform;

a second figurine;

a latching mechanism for detaching and attaching the second figurine to a top portion of the base figurine;

wherein the latching mechanism comprises a male platform including an extension having a plurality of radially projecting latching arms, each latching arm defining a circumferential span, and a receiving platform including a recess area having open entry regions and covered retention regions;

wherein the latching arms are insertable exclusively through the open entry regions in an axial direction, and engagement is completed only by rotational displacement of the second figurine which translates each latching arm from the open entry region into a covered retention region positioned above the latching arm;

wherein the covered retention regions physically block axial withdrawal of the latching arms absent reverse rotation, thereby forming a torsion-locked conjoined platform providing a semi-permanent attachment of the second figurine to the base figurine.

14. The totem display of claim 13, wherein each covered retention region includes a solid overhang surface positioned radially outward of the corresponding latching arm, such that axial upward displacement is physically blocked after rotation.

15. The totem display of claim 13, wherein the open entry regions have a circumferential width greater than a circumferential span of the latching arms to enable axial insertion.

* * * * *